US009919531B2

(12) United States Patent
Mataki et al.

(10) Patent No.: US 9,919,531 B2
(45) Date of Patent: Mar. 20, 2018

(54) NOZZLE WIPING SHEET, NOZZLE WIPING UNIT, AND IMAGE FORMING APPARATUS

(71) Applicant: FUJIFILM Corporation, Tokyo (JP)

(72) Inventors: Hiroshi Mataki, Kanagawa (JP); Jun Yamanobe, Kanagawa (JP); Hiroshi Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/432,566

(22) Filed: Feb. 14, 2017

(65) Prior Publication Data

US 2017/0151790 A1 Jun. 1, 2017

Related U.S. Application Data

(63) Continuation of application No. PCT/JP2015/074206, filed on Aug. 27, 2015.

(30) Foreign Application Priority Data

Sep. 26, 2014 (JP) ..... 2014-197250

(51) Int. Cl.
*B41J 2/165* (2006.01)
*B41J 29/38* (2006.01)

(52) U.S. Cl.
CPC ..... *B41J 2/16535* (2013.01); *B41J 2/16538* (2013.01); *B41J 2/16544* (2013.01);
(Continued)

(58) Field of Classification Search
CPC .... B41J 2/165; B41J 2/16535; B41J 2/16538; B41J 2/16544; B41J 2/16552;
(Continued)

(56) References Cited

U.S. PATENT DOCUMENTS 7,073,886 B2 * 7/2006 Nakamura ..... B41J 2/16535 347/28
7,896,462 B2 * 3/2011 Furukawa ..... B41J 2/16552 347/28

(Continued)

FOREIGN PATENT DOCUMENTS

JP H10-146984 A 6/1998
JP 2004-202773 A 7/2004

(Continued)

OTHER PUBLICATIONS

International Search Report issued in PCT/JP2015/074206; dated Nov. 10, 2015.

(Continued)

*Primary Examiner* — Anh T. N. Vo
(74) *Attorney, Agent, or Firm* — Studebaker & Brackett PC

(57) ABSTRACT

Provided are a nozzle wiping sheet, a nozzle wiping unit, and an image forming apparatus capable of preventing occurrence of streaks during printing immediately after maintenance. A wiping member (120) wipes a nozzle surface (57K) of a jetting head (56K) provided with a nozzle through which liquid droplets are jetted, in which a shape of the liquid droplet added dropwise to the wiping member (120) after a cleaning liquid (108) is added to the wiping member (120) satisfies the following condition when an aspect ratio of the liquid droplet after 40 seconds after the addition of the cleaning liquid (108) is assumed to be R, and the R is 1.3 or more.

4 Claims, 4 Drawing Sheets

(52) U.S. Cl.
CPC ..... *B41J 2/16552* (2013.01); *B41J 2/16588* (2013.01); *B41J 29/38* (2013.01)

(58) Field of Classification Search
CPC ..... B41J 2/16588; B41J 2002/1655; B41J 2002/16558; B41J 2/17509
See application file for complete search history.

(56) References Cited

U.S. PATENT DOCUMENTS

| | | | | |
|---|---|---|---|---|
| 8,002,382 | B2 * | 8/2011 | Steinfield | B41J 2/16535 347/33 |
| 8,905,516 | B2 * | 12/2014 | Inoue | B41J 2/16535 347/22 |
| 2012/0218346 | A1 * | 8/2012 | Inoue | B41J 2/16588 347/33 |

FOREIGN PATENT DOCUMENTS

| | | | |
|---|---|---|---|
| JP | 2005-021809 | A | 1/2005 |
| JP | 2005-161129 | A | 6/2005 |
| JP | 2008-137266 | A | 6/2008 |
| JP | 2012-071573 | A | 4/2012 |
| JP | 2013-169761 | A | 9/2013 |
| JP | 2014-104746 | A | 6/2014 |

OTHER PUBLICATIONS

Written Opinion issued in PCT/JP2015/074206; dated Nov. 10, 2015.

* cited by examiner

NOZZLE WIPING SHEET, NOZZLE WIPING UNIT, AND IMAGE FORMING APPARATUS

CROSS-REFERENCE TO RELATED APPLICATIONS

This application is a Continuation of PCT International Application No. PCT/JP2015/074206 filed on Aug. 27, 2015, which claims priority under 35 U.S.C § 119(a) to Patent Application No. 2014-197250 filed in Japan on Sep. 26, 2014, all of which are hereby expressly incorporated by reference into the present application.

BACKGROUND OF THE INVENTION

1. Field of the Invention

The present invention relates to a nozzle wiping sheet, a nozzle wiping unit, and an image forming apparatus.

2. Description of the Related Art

JP2008-137266A discloses a cleaning mechanism for cleaning (wiping) a nozzle surface of an ink jet recording head with a cleaning sheet (nozzle wiping sheet). In addition, as an example of the cleaning sheet, long-fiber non-woven fabric or microfiber fabric having water absorbency is described. As in JP2008-137266A, JP2005-21809A, JP2014-104746A, and JP2004-202773A disclose the material of a nozzle wiping sheet for wiping a nozzle, and the like.

SUMMARY OF THE INVENTION

However, when the nozzle surface is wiped by the nozzle wiping sheet, bubbles may be entrained into the nozzle and streaks may occur in a printed image immediately after maintenance. Here, it is known that occurrence of streaks is prevented when printing is performed after a period of time after maintenance is performed. However, from the viewpoint of productivity, another solving means is desired.

In consideration of the foregoing circumstances, an object of the present invention is to provide a nozzle wiping sheet, a nozzle wiping unit, and an image forming apparatus capable of preventing occurrence of streaks during printing immediately after maintenance.

In order to solve the problems, according to a first aspect of the present invention, a nozzle wiping sheet is a wiping member which wipes a nozzle surface of a jetting head provided with a nozzle through which liquid droplets are jetted, in which a shape of the liquid droplet added dropwise after a cleaning liquid is added satisfies the following condition when an aspect ratio of the liquid droplet after 40 seconds after the addition of the cleaning liquid is assumed to be R.

$$R \geq 1.3$$

In the nozzle wiping sheet according to the first aspect of the present invention, by using the nozzle wiping sheet in which the aspect ratio R of the liquid droplet added dropwise after the cleaning liquid is added is 1.3 or more in a state after 40 seconds after the addition of the cleaning liquid, the liquid droplet can be absorbed at an appropriate absorption rate when the nozzle wiping sheet comes into contact with the nozzle surface. That is, it is known that the reason why the aspect ratio R of the spreading liquid droplet increases is because the absorption rate of the cleaning liquid in a specific direction is delayed and the nozzle wiping sheet has a lower liquid droplet absorbing capacity than in a case where the liquid droplet spreads isotropically (the aspect ratio R is close to 1.0). Here, the nozzle wiping sheet having a high liquid droplet absorbing capacity quickly absorbs the liquid droplet, and the air easily infiltrates into the nozzle. Contrary to this, the nozzle wiping sheet in which the aspect ratio R is 1.3 or more does not quickly absorb the liquid droplet and can prevent bubbles from being entrained into the nozzle.

According to a second aspect of the present invention, a nozzle wiping unit comprises: the nozzle wiping sheet described in the first aspect; a sending-out part which continuously sends out the nozzle wiping sheet; a winding part which winds the nozzle wiping sheet that is sent out; and a pressing part which is provided on a transport path between the sending-out part and the winding part and presses nozzle wiping sheet against the nozzle surface of the jetting head.

In the nozzle wiping unit according to the second aspect of the present invention, the nozzle wiping sheet sent out from the sending-out part is pressed by the pressing part against the nozzle surface of the jetting head and wipes liquid droplets such as ink adhered to the nozzle surface. In addition, the nozzle wiping sheet that has wiped the liquid droplets is wound around the winding part. Accordingly, the nozzle surface can be efficiently wiped by the nozzle wiping sheet.

According to a third aspect of the present invention, the nozzle wiping unit further comprises a cleaning liquid adding part which adds a cleaning liquid to the nozzle wiping sheet in the nozzle wiping unit according to the second aspect.

In the nozzle wiping unit according to the third aspect of the present invention, since the nozzle surface is wiped by the nozzle wiping sheet to which the cleaning liquid is added, the nozzle surface can be effectively wiped.

According to a fourth aspect of the present invention, an image forming apparatus comprises: a recording head provided with a nozzle through which liquid droplets are jetted toward a recording medium; a recording head moving mechanism which moves the recording head between an image forming position and a maintenance position; and the nozzle wiping unit described in the fourth or fifth aspect, which is provided between the image forming position and the maintenance position to face the recording head, in which the nozzle surface of the recording head is wiped during at least one movement of movement of the recording head from the image forming position to the maintenance position or movement of the recording head from the maintenance position to the image forming position.

In the image forming apparatus according to the fourth aspect of the present invention, the nozzle surface can be wiped by the nozzle wiping unit while the recording head is moved by the head moving mechanism.

According to a fifth aspect of the present invention, in the image forming apparatus, a direction in which the recording head moves and a direction in which the liquid droplet in the nozzle wiping sheet spreads widest intersect each other in the image forming apparatus according to the fourth aspect.

In the image forming apparatus according to the fifth aspect of the present invention, the liquid droplet easily spreads in the direction intersecting the transport direction of the recording head, and thus the liquid droplet adhered when the nozzle surface is wiped can be prevented from spreading to a region in which the nozzle wiping sheet is not used. That is, re-adhesion of the wiped liquid droplet to the nozzle surface can be prevented.

According to a sixth aspect of the present invention, in the image forming apparatus, the recording head is configured so as not to jet liquid droplets onto the same position of the recording medium in the image forming apparatus according to the fourth or fifth aspect.

In the image forming apparatus according to the sixth aspect of the present invention, compared to an image forming apparatus which performs so-called multiple writing in which liquid droplets are jetted toward the same position of a recording medium, the printing speed can be enhanced.

According to a seventh aspect of the present invention, in the image forming apparatus, the recording head extends in the entire region in a width direction of the recording medium and forms an image of a single line by a single scanning operation in the image forming apparatus according to any one of the fourth to sixth aspects.

In the image forming apparatus according to the seventh aspect of the present invention, compared to a so-called shuttle scan type image forming apparatus which performs printing while repeatedly moving a recording head, the printing speed can be enhanced.

According to an eighth aspect of the present invention, in the image forming apparatus, the liquid droplet jetted from the recording head includes a pigment, polymer particles, and water, and the cleaning liquid added to the nozzle wiping sheet includes a water-soluble organic solvent represented by General Formula (I) and water, in the image forming apparatus according to any one of the fourth to seventh aspects.

$$R^3\text{-}(\text{-}OR^4\text{-})_x OR^5 \qquad \text{General Formula (I)}$$

As described above, in the nozzle wiping sheet, the nozzle wiping unit, and the image forming apparatus according to the present invention, occurrence of streaks during printing immediately after maintenance can be prevented.

DESCRIPTION OF THE PREFERRED EMBODIMENTS

Figure 1:
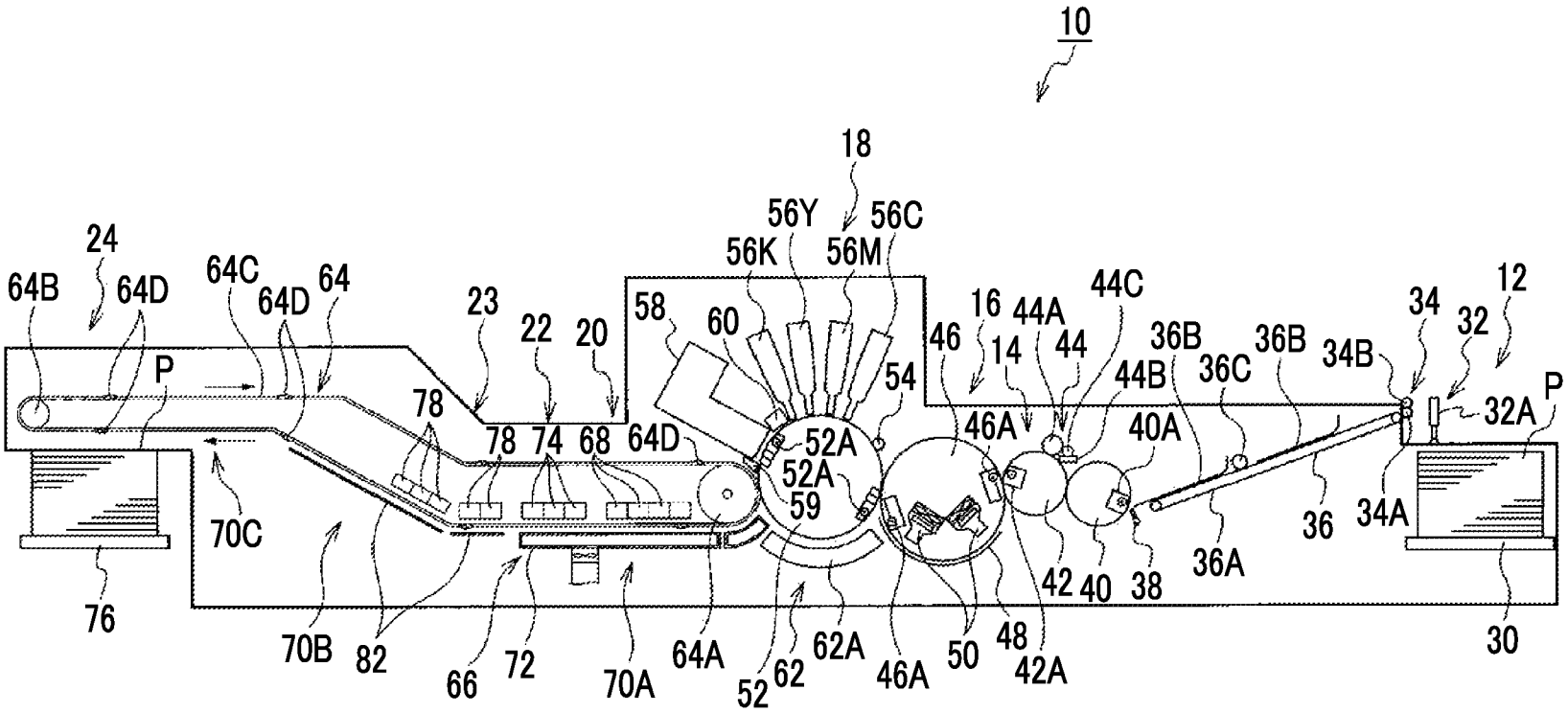
FIG. 1 is a diagram of the overall configuration of an image forming apparatus according to an embodiment.

Hereinafter, an embodiment according to the present invention will be described with reference to the accompanying drawings. In the embodiment, an example in which the present invention is applied to an image forming apparatus that uses an aqueous pigment ink will be described. In addition, like elements having similar functions in the drawings are denoted by like reference numerals, and descriptions will be appropriately omitted.

(Overall Configuration of Image Forming Apparatus)

As illustrated in FIG. 1, an image forming apparatus 10 according to the embodiment is configured to record an image on a sheet-like recording medium (sheet) P using an aqueous pigment ink in an ink jet manner. The image forming apparatus 10 is configured to include a feeding part 12 which feeds the recording medium P, transporting means for transporting the recording medium P, a processing liquid adding part 14, a processing liquid drying part 16, an image forming part 18, a heating and drying part 20, a UV irradiation part 22, a cooling part 23, a discharge part 24 which discharges the recording medium P, and a control part.

(Feeding Part)

The feeding part 12 is configured to feed the recording media P stacked on a feeding table 30 to the processing liquid adding part 14 one by one. The feeding part 12 is mainly constituted by the feeding table 30, a sucker device 32, a feeding roller pair 34, a feeder board 36, a front guard 38, and a feeding drum 40.

A large number of the recording media P are loaded on the feeding table 30 in a state of being stacked as a bundle. The feeding table 30 is provided so as to be elevated by a feeding table elevating device (not illustrated). The feeding table elevating device is controlled to be driven in conjunction with variation in the recording media P stacked on the feeding table 30. In addition, the feeding table 30 is elevated to cause the recording medium P at the uppermost position of the bundle to be always at a constant height.

The recording medium P is not particularly limited, and general-purpose printing sheets (so-called high-quality paper, coated paper, and art paper or other cellulose-based sheets) used in general offset printing or the like may be used.

In the sucker device 32, the recording media P stacked on the feeding table 30 are picked up one by one in order from above and are fed to the feeding roller pair 34. The sucker device 32 includes a suction foot 32A provided to be elevated and oscillated. The upper surface of the recording medium P is adsorbed and held by the suction foot 32A and the recording medium P is transported to the feeding roller pair 34 from the feeding table 30. At this time, the suction foot 32A is configured to adsorb and hold the upper surface of the leading end side of the recording medium P positioned at the uppermost position of the bundle so as to cause the recording medium P to be pulled upward, and to cause the leading end of the recording medium P pulled upward to be inserted between a pair of rollers 34A and 34B constituting the feeding roller pair 34.

The feeding roller pair 34 is constituted by the pair of upper and lower rollers 34A and 34B which come into pressing contact with each other. One of the pair of upper and lower rollers 34A and 34B is a driving roller (for example, the roller 34A), and the other thereof is a driven roller (for example, the roller 34B). The driving roller is connected to a motor (not illustrated) and is driven to rotate by the rotation of the motor. The motor is driven in conjunction with the feeding of the recording medium P, and when the recording medium P is fed from the sucker device 32, the motor rotates the driving roller according to the timing. The recording medium P inserted between the pair of upper and lower rollers 34A and 34B is nipped between the rollers 34A and 34B and is sent out in an installation direction of the feeder board 36.

The feeder board 36 is formed to correspond to the recording medium width and is configured to guide the recording medium P sent out from the feeding roller pair 34 to the front guard 38. The feeder board 36 is provided to be inclined downward, and the recording medium P placed on a transport surface of a transport path of the feeder board 36 slides along the transport surface and is guided to the front guard 38.

In the feeder board 36, a plurality of tape feeders 36A which transport the recording medium P and have the transport direction as the longitudinal direction are provided with intervals therebetween in the width direction. The tape feeder 36A is formed in an endless shape and is configured to rotate by a motor (not illustrated) as a driving source. The recording medium P placed on the transport surface of the feeder board 36 is transported on the feeder board 36 by the tape feeders 36A.

On the feeder board 36, retainers 36B and a roller 36C are provided. A plurality of (in this embodiment, two) the retainers 36B are arranged in tandem in the front and rear along the transport surface of the recording medium P. The retainer 36B is configured as a plate spring having a width corresponding to the recording medium width and comes into pressing contact with the transport surface. As the recording medium P transported on the feeder board 36 by the tape feeders 36A passes through the retainers 36B, unevenness of the recording medium P is corrected. The roller 36C is disposed between the retainer 36B disposed on the upstream side in the transport direction and the retainer 36B on the downstream side. The roller 36C comes in pressing contact with the transport surface of the recording medium P. The recording medium P is transported between the retainers 36B while the upper surface thereof is pressed by the roller 36C.

The front guard 38 corrects the posture of the recording medium P. The front guard 38 is formed in a plate shape, and the plate-like surface thereof is disposed to be perpendicular to the transport direction of the recording medium P. In addition, the front guard 38 is connected to a motor (not illustrated), and is driven by the motor so as to be oscillated. At a time point at which the leading end of the recording medium P transported on the feeder board 36 abuts the front guard 38, the transporting posture of the recording medium P is corrected (so-called skew prevention is performed). The front guard 38 is oscillated in conjunction with feeding of the recording medium P to the feeding drum 40, and the recording medium P of which the transporting posture is corrected is delivered to the feeding drum 40.

The feeding drum 40 receives the recording medium P fed from the feeder board 36 via the front guard 38 and transports the recording medium P to the processing liquid adding part 14. The feeding drum 40 is formed in a cylindrical shape, is connected to a motor (not illustrated), and is rotated by driving force of the motor. A gripper 40A is provided on the outer circumferential surface of the feeding drum 40, and the leading end of the recording medium P is gripped by the gripper 40A. As the gripper 40A grips and rotates the leading end of the recording medium P, the feeding drum 40 transports the recording medium P to the processing liquid adding part 14 while winding the recording medium P around the circumferential surface.

(Processing Liquid Adding Part)

The processing liquid adding part 14 adds a processing liquid to the surface (image recording surface) of the recording medium P. The processing liquid adding part 14 is mainly constituted by a processing liquid adding drum 42 which transports the recording medium P, and a processing liquid adding unit 44 which adds the processing liquid to the image recording surface of the recording medium P transported by the processing liquid adding drum 42. The processing liquid added to the surface of the recording medium P is an aggregating agent having a function of causing a coloring material (pigment) in the photocurable ink jetted onto the recording medium P in the image forming part 18 disposed on the downstream side in the transport direction, to collect.

The processing liquid adding drum 42 transports the recording medium P transported from the feeding drum 40 of the feeding part 12 to the processing liquid drying part 16. The processing liquid adding drum 42 is formed in a cylindrical shape, is connected to a motor (not illustrated), and is rotated by driving force of the motor. Gripper 42A are provided on the outer circumferential surface of the processing liquid adding drum 42, and the gripper 42A is configured to grip the leading end of the recording medium P. As the gripper 42A grips and rotates the leading end of the recording medium P, the processing liquid adding drum 42 transports the recording medium P to the processing liquid drying part 16 while winding the recording medium P around the circumferential surface. When the processing liquid adding drum 42 rotates once, a single recording medium P is transported. Rotation of the processing liquid adding drum 42 and the feeding drum 40 is controlled so as to cause reception and delivery timings of the recording medium P of the two to be coincident with each other. That is, the processing liquid adding drum 42 and the feeding drum 40 are driven while causing the circumferential speeds of the two to be coincident with each other and are driven while causing the positions of the grippers 40A and 42A of the two to be coincident with each other.

In the processing liquid adding unit 44, the processing liquid is applied to the surface of the recording medium P transported by the processing liquid adding drum 42. The processing liquid adding unit 44 is mainly constituted by an application roller 44A which applies the processing liquid to the recording medium P, a processing liquid tank 44B which stores the processing liquid, and a drawing roller 44C which draws the processing liquid stored in the processing liquid tank 44B and supplies the processing liquid to the application roller 44A.

In the embodiment, the configuration in which the processing liquid is applied by the rollers is employed. However, a method of adding the processing liquid is not limited thereto. For the application of the processing liquid, an application method using an ink jet head, or an application method using a spray may also be employed.

(Processing Liquid Drying Part)

In the processing liquid drying part 16, the recording medium P having the processing liquid added to the surface thereof is dried. The processing liquid drying part 16 is mainly constituted by a processing liquid drying drum 46 which transports the recording medium P, a sheet transport guide 48, and a processing liquid drying unit 50 which blows dry wind toward the image forming surface of the recording medium P transported by the processing liquid drying drum 46 so as to be dried.

The processing liquid drying drum 46 is configured to receive the recording medium P from the processing liquid adding drum 42 of the processing liquid adding part 14 and transport the recording medium P to the image forming part 18. The processing liquid drying drum 46 is configured as a frame body assembled in a cylindrical shape, is connected to a motor (not illustrated), and is rotated by driving force of the motor. A gripper 46A is provided on the outer circumferential surface of the processing liquid drying drum 46, and the leading end of the recording medium P is gripped by the gripper 46A. As the gripper 46A grips and rotates the leading end of the recording medium P, the processing liquid drying drum 46 transports the recording medium P to the image forming part 18. In addition, in the processing liquid drying drum 46 in this embodiment, the grippers 42A are disposed at two points on the outer circumferential surface and are configured to transport two recording media P by one rotation. Rotation of the processing liquid drying drum 46 and the processing liquid adding drum 42 is controlled so as to cause reception and delivery timings of the recording medium P of the two to be coincident with each other. That is, the processing liquid drying drum 46 and the processing liquid adding drum 42 are driven while causing the circumferential speeds of the two to be coincident with each other and are driven while causing the positions of the grippers 42A and 46A thereof to be coincident with each other.

The sheet transport guide 48 is disposed around the outer periphery of the processing liquid drying drum 46 along the transport path of the recording medium P. The sheet transport guide 48 guides the recording medium P so as not to deviate from the processing liquid drying drum 46 (transport path).

The processing liquid drying unit 50 is installed on the inside of the processing liquid drying drum 46, and is configured to blow dry wind toward the surface of the recording medium P transported by the processing liquid drying drum 46 so as to be dried. Accordingly, solvent components in the processing liquid are removed, and an ink aggregating layer is formed on the surface of the recording medium P. In this embodiment, two processing liquid drying units 50 are disposed in the processing liquid drying drum and are configured to blow dry wind toward the surface of the recording medium P transported by the processing liquid drying drum 46.

(Image Forming Part)

The image forming part 18 is configured to record (print or draw) a color image on an image formation surface of the recording medium P by jetting liquid droplets of ink with M, K, C, and Y colors onto the image formation surface of the recording medium P. The image forming part 18 is configured to mainly include an image forming drum 52 which transports the recording medium P, a recording medium pressing roller 54 which causes the recording medium P to come into close contact with the circumferential surface of the image forming drum 52 by pressing the recording medium P transported by the image forming drum 52, ink jet heads 56M, 56K, 56C, and 56Y (hereinafter, collectively referred to as "ink jet head 56") as an example of jetting heads, which jet color ink droplets (liquid droplets) with M, K, C, and Y colors onto the recording medium P, an inline sensor 58 which reads the image recorded on the recording medium P, a mist filter 60 which captures ink mist, and a drum cooling unit 62.

The image forming drum 52 is configured to receive the recording medium P from the processing liquid drying drum 46 of the processing liquid drying part 16 and transport the recording medium P to the heating and drying part 20. The image forming drum 52 is formed in a cylindrical shape, is connected to a motor (not illustrated), and is rotated by driving force of the motor. Grippers 52A are provided on the outer circumferential surface of the image forming drum 52, and the leading end of the recording medium P is gripped by the gripper 52A. As the gripper 52A grips and rotates the leading end of the recording medium P, the image forming drum 52 transports the recording medium P to the heating and drying part 20 while winding the recording medium P around the circumferential surface. In addition, a large number of adsorption holes (suction holes) (not illustrated) are provided in the circumferential surface of the image forming drum 52 in a predetermined pattern. The recording medium P wound around the circumferential surface of the image forming drum 52 is suctioned through the adsorption holes and thus can be transported while being adsorbed and held onto the circumferential surface of the image forming drum 52. Accordingly, the recording medium P can be transported with high smoothness.

In addition, adsorption through the adsorption holes is performed on only a predetermined range such that the recording medium P is adsorbed between a predetermined adsorption start position to a predetermined adsorption end position. The adsorption start position is set to an installation position of the recording medium pressing roller 54. The adsorption end position is set to be on the downstream side of an installation position of the inline sensor 58, and for example, is set to a position at which the recording medium P is delivered to the heating and drying part 20. That is, the adsorption holes are set to cause the recording medium P to be adsorbed and held onto the circumferential surface of the image forming drum 52 at least at an installation position (image forming position) of the ink jet head 56 or the installation position (image reading position) of the inline sensor 58. In addition, an adsorption method is not limited to the adsorption method using negative pressure, and may also be an adsorption method using electrostatic adsorption.

In addition, in the image forming drum 52 in this embodiment, the grippers 52A are disposed at two points on the outer circumferential surface and can transport two recording media P by one rotation. Rotation of the image forming drum 52 and the processing liquid drying drum 46 is controlled so as to cause reception and delivery timings of the recording medium P of the two to be coincident with each other. That is, the image forming drum 52 and the processing liquid drying drum 46 are driven while causing the circumferential speeds thereof to be coincident with each other and are driven while causing the positions of the grippers 46A and 52A thereof to be coincident with each other.

The recording medium pressing roller 54 is disposed in the vicinity of a reception position (a position at which the recording medium P is received from the processing liquid drying drum 46) of the recording medium P of the image forming drum 52. The recording medium pressing roller 54 is configured as, for example, a rubber roller and is installed to come into pressing contact with the circumferential surface of the image forming drum 52. The recording medium P delivered from the processing liquid drying drum 46 to the image forming drum 52 is nipped by passing through the recording medium pressing roller 54 and thus comes into close contact with the circumferential surface of the image forming drum 52.

The four ink jet heads 56M, 56K, 56C, and 56Y are disposed at predetermined intervals on the outer circumferential surface of the image forming drum 52 along the transport path of the recording medium P. Each of the ink jet heads 56M, 56K, 56C, and 56Y is configured as a line head corresponding to the recording medium width and is configured so that a nozzle surface thereof is disposed to face the circumferential surface of the image forming drum 52. Each of the ink jet heads 56M, 56K, 56C, and 56Y forms an image on the recording medium P transported by the image forming drum 52 by jetting liquid droplets of the ink toward the image forming drum 52 from nozzle rows formed in the nozzle surface.

Here, in this embodiment, as an example, the ink jet head 56 is configured so as not to jet the ink onto the same position of the recording medium P. That is, the ink jet head 56 is configured so as not to perform multiple writing. In addition, the ink jet head 56 is configured to perform image formation in a single pass manner in which an image of a single line is formed by a single scanning operation.

Figure 2:
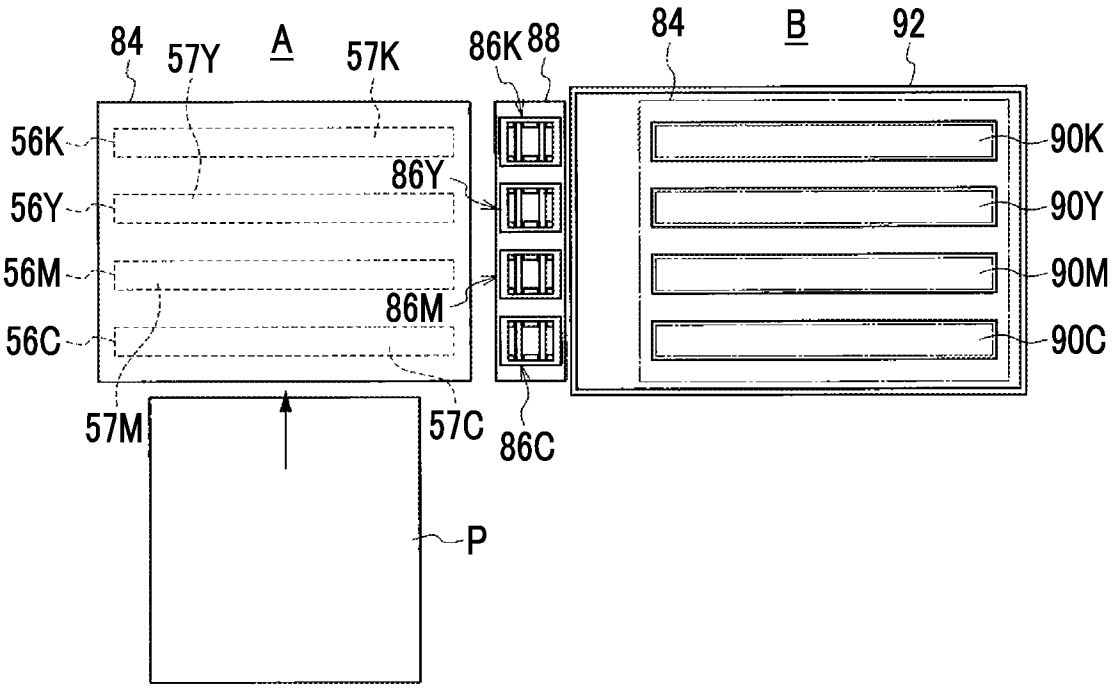
FIG. 2 is a schematic plan view schematically illustrating an image forming part and a maintenance part of the image forming apparatus illustrated in FIG. 1.

In addition, as illustrated in FIG. 2, the four ink jet heads 56M, 56K, 56C, and 56Y are supported by a head support frame 84 and are configured to move between an image forming position A at which an image is formed and a maintenance position B at which maintenance is performed. In addition, between the image forming position A and the maintenance position B, nozzle wiping units 86K, 86Y, 86M, and 86C (hereinafter, collectively referred to as "nozzle wiping unit 86") are disposed. Details of the nozzle wiping unit 86 will be described later.

The inline sensor 58 is installed closer to the downstream side than the rearmost ink jet head 56K in the transport direction. The inline sensor 58 is configured to read the image recorded by the ink jet heads 56K, 56Y, 56M, and 56C. The inline sensor 58 is configured as, for example, a line scanner.

In addition, on the downstream side of the inline sensor 58, a contact prevention plate 59 installed close to the inline sensor 58 is provided. The contact prevention plate 59 can prevent contact between the inline sensor 58 and the recording medium P in a case where lifting, folding, or the like of the recording medium P occurs due to transport problems or the like.

The mist filter 60 is disposed between the rearmost ink jet head 56Y and the inline sensor 58 and captures ink mist by suctioning air in the vicinity of the image forming drum 52. By capturing the ink mist, infiltration of the ink mist into the inline sensor 58 is prevented, and occurrence of image reading failure or the like is effectively prevented.

The drum cooling unit 62 is configured to cool the image forming drum 52 by blowing cold air toward the image forming drum 52. The drum cooling unit 62 is mainly constituted by an air conditioner (not illustrated) and a duct 62A through which the cold air supplied from the air conditioner is blown toward the circumferential surface of the image forming drum 52. The duct 62A is configured to cool the image forming drum 52 by blowing cold air toward the image forming drum 52 in a region other than a transport region of the recording medium P. In this embodiment, since the recording medium P is transported along the arc-shaped outer circumferential surface of substantially the upper half of the image forming drum 52, the duct 62A cools the image forming drum 52 by blowing cold air toward a region of substantially the lower half of the image forming drum 52. Specifically, outlets (not illustrated) of the duct 62A are arranged in an arc shape so as to cover substantially the lower half of the image forming drum 52.

(Heating and Drying Part)

The heating and drying part 20 removes liquid components remaining on the image surface of the recording medium P by drying the recording medium P after the image recording. The heating and drying part 20 is configured to mainly include a chain gripper 64 as an example of transporting means for transporting the recording medium P on which an image is recorded, a back tension (tension) applying mechanism 66 which applies back tension to the recording medium P transported by the chain gripper 64, and drying units 68 which heat and dry the recording medium P transported by the chain gripper 64.

The chain gripper 64 is a sheet transporting mechanism which is used in the heating and drying part 20, the UV irradiation part 22, and the discharge part 24 in common, receives the recording medium P delivered from the image forming part 18, and transports the recording medium P to the discharge part 24.

The chain gripper 64 is configured to mainly include a first sprocket 64A installed close to the image forming drum 52, and a second sprocket 64B installed in the discharge part 24. In addition, endless chains 64C are wound around the first sprocket 64A and the second sprocket 64B. Furthermore, a plurality of chain guides (not illustrated) which guide the travelling of the chain 64C are provided, and a plurality of grippers 64D are attached to the chain 64C with predetermined intervals therebetween. The first sprocket 64A, the second sprocket 64B, the chains 64C, and the chain guides form a pair and are disposed on both sides in the transport width direction of the recording medium P. The gripper 64D is provided to be laid across the chains 64C provided as a pair.

The first sprocket 64A is installed close to the image forming drum 52 so that the recording medium P delivered from the image forming drum 52 can be received by the gripper 64D. The first sprocket 64A is supported by a bearing (not illustrated) so as to rotate, and is connected to a motor (not illustrated) via a gear. The chain 64C wound around the first sprocket 64A and the second sprocket 64B travels as the motor is driven.

The second sprocket 64B is installed in the discharge part 24 so that the recording medium P received from the image forming drum 52 can be collected by the discharge part 24. That is, an installation position of the second sprocket 64B is regarded as the end of the transport path of the recording medium P by the chain gripper 64. The second sprocket 64B is supported by a bearing (not illustrated) so as to rotate.

The chain 64C is formed in an endless shape and is wound around the first sprocket 64A and the second sprocket 64B.

The chain guides are disposed at predetermined positions and guide the chain 64C to travel along a predetermined path. In this embodiment, the second sprocket 64B is disposed at a higher position than the first sprocket 64A. Therefore, a travelling path in which the chain 64C is inclined partway is formed. Specifically, the travelling path is constituted by a first horizontal transport path 70A, an inclined transport path 70B, and a second horizontal transport path 70C.

The first horizontal transport path 70A is set to be at the same height as that of the first sprocket 64A and is set to cause the chain 64C wound around the first sprocket 64A to travel horizontally. The second horizontal transport path 70C is set to be at the same height as that of the second sprocket 64B and is set to cause the chain 64C wound around the second sprocket 64B to travel horizontally. The inclined transport path 70B is set between the first horizontal transport path 70A and the second horizontal transport path 70C to connect the first horizontal transport path 70A and the second horizontal transport path 70C to each other.

The chain guides are disposed to form the first horizontal transport path 70A, the inclined transport path 70B, and the second horizontal transport path 70C. Specifically, the chain guides are disposed at least at a joint point between the first horizontal transport path 70A and the inclined transport path 70B or a joint point between the inclined transport path 70B and the second horizontal transport path 70C.

The plurality of grippers 64D are attached to the chain 64C with predetermined intervals therebetween. The attachment intervals between the grippers 64D are set according to intervals at which the recording media P are received from the image forming drum 52. That is, the attachment intervals are set according to the intervals at which the recording media P are received from the image forming drum 52 so that the recording media P sequentially delivered from the image forming drum 52 are received from the image forming drum 52 at adjusted timings.

The chain gripper 64 is configured as follows. As described above, when the motor (not illustrated) connected to the first sprocket 64A is driven, the chain 64C travels. The chain 64C travels at the same speed as the circumferential speed of the image forming drum 52. In addition, the timings can be adjusted to cause the recording medium P delivered from the image forming drum 52 to be received by each gripper 64D.

The back tension applying mechanism 66 applies back tension to the recording medium P transported while the leading end thereof is gripped by the chain gripper 64. The back tension applying mechanism 66 mainly includes a guide plate 72 as a transport path disposed in the heating and drying part 20.

The guide plate 72 is configured as a hollow box plate having a width corresponding to the width of the recording medium P. In addition, on the upper surface of the guide plate 72, a large number of suction holes (not illustrated) are formed. Furthermore, to the lower side of the guide plate 72, an exhaust pipe for discharging the air suctioned from the large number of suction holes by a suction fan is connected.

The guide plate 72 configured as described above is disposed along the transport path of the recording medium P by the chain gripper 64 and forms the transport path of the recording medium P. Specifically, the guide plate 72 is disposed along the chain 64C that travels along the first horizontal transport path 70A and is disposed on the lower side at a predetermined distance from the chain 64C. Therefore, the recording medium P transported on the outer circumferential side of the chain 64C by the chain gripper 64 is transported while being dragged in a state in which the surface on the side opposite to the drawing surface is suctioned onto the upper surface of the guide plate 72.

The large number of suction holes formed on the upper surface of the guide plate 72 suction portions of the recording medium P excluding the leading end portion gripped by the gripper 64D by the suction fan suctioning the hollow portion (inner portion) of the guide plate 72. Accordingly, back tension (tension) is applied to the recording medium P transported by the chain gripper 64.

As described above, since the guide plate 72 is disposed along the chain 64C that travels along the first horizontal transport path 70A, back tension is applied thereto while the recording medium P is transported along the first horizontal transport path 70A.

A plurality of the drying units 68 are disposed along the first horizontal transport path 70A. In this embodiment, as an example, four drying units 68 are provided along the first horizontal transport path 70A. Accordingly, while the recording medium P passes under the four drying units 68, the drying units 68 blows the heated air (warm wind) toward the recording medium P such that the recording medium P is heated and dried.

The number of drying units 68 to be installed is set according to the processing capacity of the drying units 68, the transport speed of the recording medium P, and the like. That is, the installation number is set so that the recording medium P received from the image forming part 18 can be dried while being transported along the first horizontal transport path 70A.

The heating and drying part 20 is configured as described above. The recording medium P delivered from the image forming drum 52 of the image forming part 18 is received by the chain gripper 64. The chain gripper 64 transports the recording medium P in a state in which the leading end portion of the recording medium P is gripped by the gripper 64D and is lifted from the guide plate 72 and the trailing end of the recording medium P is in contact with the guide plate 72. The recording medium P delivered to the chain gripper 64 is first transported along the first horizontal transport path 70A. In a procedure in which the recording medium P is transported along the first horizontal transport path 70A, warm wind is blown from the drying unit 68 toward the recording medium P such that a heating and drying process is performed. At this time, since the recording medium P is subjected to the drying process while being subjected to back tension (tension) by the back tension applying mechanism 66, occurrence of drying unevenness and wrinkles can be prevented.

(UV Irradiation Part)

The UV irradiation part 22 irradiates the drawing surface of the recording medium P, to which the ink is jetted, with ultraviolet rays as an example of active energy rays to cure the ink such that the image is fixed. Active energy rays mentioned herein indicate energy rays capable of generating initiating species in an ink composition through irradiation and broadly include a rays, y rays, X-rays, ultraviolet rays, visible rays, and electron beams, and the like. Among these, from the viewpoint of curing sensitivity and apparatus availability, ultraviolet rays or electron beams are preferably used, and ultraviolet rays are more preferable.

The UV irradiation part 22 is mainly constituted by the chain gripper 64 which transports the recording medium P, the back tension applying mechanism 66 which applies back tension to the recording medium P transported by the chain gripper 64, and UV irradiation units 74 which irradiate the recording medium P transported by the chain gripper 64 with ultraviolet rays. In addition, the chain gripper 64 and the back tension applying mechanism 66 are used in common with the heating and drying part 20.

The UV irradiation units 74 are disposed to face the guide plate 72 on the inner circumferential side of the chain 64C downstream of the drying units 68 in the transport direction, and irradiates the drawing surface of the recording medium P, which has passed through the heating and drying part 20, with ultraviolet rays (UV).

(Cooling Part)

The cooling part 23 cools the recording medium P heated and dried by the heating and drying part 20 and irradiated with ultraviolet rays by the UV irradiation part 22. The cooling part 23 is mainly constituted by the chain gripper 64 which transports the recording medium P irradiated with UV, support plates 82 as an example of transport surfaces that support the recording medium P transported by the chain gripper 64 and slidably comes into contact with the recording medium P, and blowing units 78 which blow wind toward the recording medium P transported by the chain gripper 64.

As described above, the chain gripper 64 is used in common with the heating and drying part 20 and the UV irradiation part 22. The support plates 82 are disposed along the chain 64C travelling along the first horizontal transport path 70A and the inclined transport path 70B.

A plurality of the blowing units 78 are disposed to face the support plates 82 (transport surfaces). In this embodiment, as an example, two blowing units 78 are provided to face the support plate 82 disposed in the first horizontal transport path 70A, and three blowing units 78 are provided to face the support plate 82 disposed in the inclined transport path 70B. Air is blown from each of the blowing units 78 toward the recording medium P such that the surface (drawing surface) of the recording medium P is cooled. The cooled recording medium P is transported to the second horizontal transport path 70C.

(Discharge Part)

The discharge part 24 is configured to collect the recording medium P subjected to a series of image forming processes. The discharge part 24 is configured to mainly include the chain gripper 64 which transports the recording medium P on which the ink is fixed, and a discharge table 76 on which the recording media P are stacked and collected. In the discharge table 76, sheet guards (a front sheet guide, a rear sheet guard, a transverse sheet guide, and the like) for orderly stacking the recording media P are provided. In addition, in the discharge table 76, a discharge table elevating device (not illustrated) is provided to elevate the recording media P. The discharge table elevating device is controlled to be elevated in conjunction with variation in the recording media P collected on the discharge table 76, and is adjusted so that the recording medium P at the uppermost position is always at a constant height.

(Ink)

As the ink used in this embodiment, for example, an aqueous ultraviolet ink which is cured by being irradiated with ultraviolet rays as light is used. The aqueous ultraviolet ink preferably includes a pigment, polymer particles, a water-soluble polymerizable compound which is polymerized by active energy rays, and a photopolymerization initiator. When the aqueous ultraviolet ink is irradiated with ultraviolet rays and is cured, the image obtains excellent rub resistance and the image achieves high film hardness. In addition, as the coloring material, a dye may also be included.

—Preparation of Ink—

In this embodiment, as an example, self-dispersing polymer particles A-01, a water-insoluble polymer dispersant P-1, and water dispersion of a cyan pigment dispersion liquid C were used, and the components were mixed to achieve the following ink composition. Next, a disposable plastic syringe was filled with the mixture, and the mixture was filtered by a polyvinylidene fluoride (PVDF) filter having a pore diameter of 5 μm (Millex-SV manufactured by Merck Millipore Corporation, diameter 25 mm), thereby obtaining a cyan ink (ink composition). The pH (25° C.) of the cyan ink (stock solution) was set to 8.3.

<Ink Composition>

Pigment Blue 15:3 (cyan pigment) 2.5 mass %

Water-insoluble polymer dispersant P-1 (solid content) 1.25 mass %

Self-dispersing polymer particles A-01 (solid content) 8.0 mass %

Sannix GP-250 10.0 mass % (average molecular weight 250, manufactured by Sanyo Chemical Industries, Ltd.)

TPGmME 4.0 mass % (tripropylene glycol monomethyl ether; the same applies hereinafter)

DPG (dipropylene glycol; the same applies hereinafter) 4.0 mass %

OLFINE E1010 (surfactant, manufactured by Nissin Chemical Industry Co., Ltd.) 1.0 mass %

Urea 5.0 mass %

SNOWTEX XS (manufactured by Nissan Chemical Industries, Ltd., colloidal silica) 0.3 mass %

Deionized water residual amount when the total amount is 100 mass %

—Preparation of Self-Dispersing Polymer Particles A-01—

360.0 g of methyl ethyl ketone was put into a 2-liter three-neck flask equipped with a stirrer, a thermometer, a reflux condenser tube, and a nitrogen gas inlet tube and was increased in temperature to 75° C. A mixed solution consisting of 162.0 g of methyl methacrylate, 126.0 g of isobornyl methacrylate, 50.4 g "PME-100" (methoxypolyethylene glycol methacrylate (n=2), manufactured by NOF Corporation), 21.6 g of methacrylic acid, 72 g of methyl ethyl ketone, 1.44 g of "V-601" (manufactured by Wako Pure Chemical Industries, Ltd.) was added thereto dropwise at a constant rate such that the dropwise addition was completed within two hours. After the dropwise addition was completed, a solution consisting of 0.72 g of "V-601" and 36.0 g of methyl ethyl ketone was added thereto, and the resultant was stirred at 75° C. for two hours. Thereafter, a solution consisting of 0.72 g of "V-601" and 36.0 g of methyl ethyl ketone was added thereto, and the resultant was stirred at 75° C. for two hours. Thereafter, the resultant was increased in temperature to 85° C. and was further stirred for two hours continuously, thereby obtaining a resin solution of a copolymer of methyl methacrylate/isobornyl methacrylate/PME-100/methacrylic acid (=45/35/14/6 [mass ratio]).

The weight average molecular weight (Mw) of the obtained copolymer was 65000 (calculated in terms of polystyrene by GPC), the acid value thereof was 39 mgKOH/g, and the glass transition temperature (Tg) thereof was 92° C.

Next, 668.3 g of the obtained resin solution was weighed, 388.3 g of isopropanol and 145.7 mL of 1 mol/L NaOH aqueous solution were added thereto, and the temperature inside a reaction vessel was increased to 80° C. Next, 720.1 g of distilled water was added dropwise at a rate of 20 mL/min such that the resultant was dispersed in water. Thereafter, under atmospheric pressure, the temperature inside the reaction vessel was held at 80° C. for two hours, at 85° C. for two hours, and at 90° C. for 2 hours, the inside of the reaction vessel was thereafter reduced in pressure, a total of 913.7 g of isopropanol, methyl ethyl ketone, and distilled water was distilled off, thereby obtaining water dispersion (emulsion) of self-dispersing polymer particles A-01 in which the concentration of solid contents was 28.0%.

—Preparation of Water-Insoluble Polymer Dispersant P-1—

88 g of methyl ethyl ketone was added to a 1000-mL three-neck flask equipped with a stirrer and a cooling tube and was heated to 72° C. in a nitrogen atmosphere. A solution in which 0.85 g of dimethyl 2,2'-azobisisobutyrate, 60 g of benzyl methacrylate, 10 g of methacrylic acid, and 30 g of methyl methacrylate were dissolved in 50 g of methyl ethyl ketone was added thereto dropwise for three hours. After the dropwise addition ended, the resultant was subjected to a reaction for one hour. Thereafter, a solution in which 0.42 g of dimethyl 2,2'-azobisisobutyrate was dissolved in 2 g of methyl ethyl ketone was added thereto, and the resultant was increased in temperature to 78° C. and was heated for four hours. The obtained reaction solution was subjected to reprecipitation by a large excess of hexane twice, and the precipitated resin was dried. In this manner, 96 g of a copolymer of benzyl methacrylate/methacrylic acid/methyl methacrylate (=60/10/30 [mass ratio]) (water-insoluble polymer dispersant P-1) was obtained.

The composition of the obtained copolymer was checked by $^{1}$H-NMR, and the weight average molecular weight (Mw) thereof determined by GPC was 44,600. In addition, the acid value thereof was 65.2 mgKOH/g.

—Preparation of Cyan Pigment Dispersion Liquid C—

5.0 g of the water-insoluble polymer dispersant P-1 obtained as described above, 10.0 g of Pigment Blue 15:3 (manufactured by Dainichiseika Color & Chemicals Mfg. Co., Ltd.), 40.0 g of methyl ethyl ketone, 8.0 g of 1 mol/L sodium hydroxide, 82.0 g of deionized water, and 300 g of 0.1 mm zirconia beads were supplied to a vessel and were dispersed for six hours at 1000 rpm with a bead mill disperser (manufactured by AIMEX Co., Ltd.). The obtained pigment dispersion liquid was concentrated under reduced pressure with an evaporator until methyl ethyl ketone was sufficiently distilled off, and was concentrated until the pigment concentration reached about 12 mass %.

Thereafter, the pigment dispersion liquid was subjected to centrifugation at 8000 rpm for 30 minutes to remove coarse particles remaining as precipitates. The absorbance of the supernatant was measured and the pigment concentration was determined.

As described above, the cyan pigment dispersion liquid C was prepared. The average particle size of the pigment particles dispersed in the dispersion liquid was 97 nm.

(Nozzle Wiping Unit)

Next, the nozzle wiping unit 86 will be described with reference to FIGS. 2 and 3. In addition, in FIG. 3, the nozzle wiping unit 86K is illustrated. However, the other nozzle wiping units 86Y, 86M, and 86C also have the same configuration. As illustrated in FIG. 2, the nozzle wiping unit 86 is disposed between the image forming position A at which an image is formed and the maintenance position B at which maintenance of the ink jet head 56 is performed. In addition, the nozzle wiping units 86K, 86Y, 86M, and 86C are disposed at positions respectively corresponding to the ink jet heads 56K, 56Y, 56M, and 56C.

Here, the image forming position A is set in the image forming part 18 of FIG. 1. In addition, for the convenience of description, FIG. 2 illustrates only main parts, and illustration of the image forming drum 52, the processing liquid drying drum 46 which transports the recording medium P, and the like is omitted. However, the image forming drum 52 is disposed below the ink jet heads 56K, 56Y, 56M, and 56C (see FIG. 1). At the image forming position A, image formation is performed by jetting ink toward the recording medium P transported from the upstream side in the transport direction.

On the other hand, the maintenance position B is set on the side opposite to the image forming position A with the nozzle wiping unit 86 interposed therebetween. At the maintenance position B, caps 90K, 90Y, 90M, and 90C (hereinafter, collectively referred to as "cap 90") for covering nozzle surfaces 57K, 57Y, 57M, and 57C (hereinafter, collectively referred to as "nozzle surface 57") of the respective ink jet heads 56K, 56Y, 56M, and 56C are provided. Here, the head support frame 84 which supports the ink jet head 56 is provided with a moving mechanism (jetting head moving mechanism) (not illustrated), and the ink jet head 56 is configured to be able to move between the image forming position A and the maintenance position B by the moving mechanism. In addition, when the image forming apparatus 10 is stopped for a long period of time or the like, the ink jet head 56 supported by the head support frame 84 is moved to the maintenance position B and the nozzle surface of the ink jet head 56 is covered by the cap 90 such that non-jetting caused by drying or the like can be prevented.

The nozzle wiping unit 86 provided between the image forming position A and the maintenance position B is configured to cause a band-like nozzle wiping sheet (web) 120 as a wiping member to abut the ink jet head 56 while travelling and wipe the nozzle surface 57 of the ink jet head 56.

Figure 3:
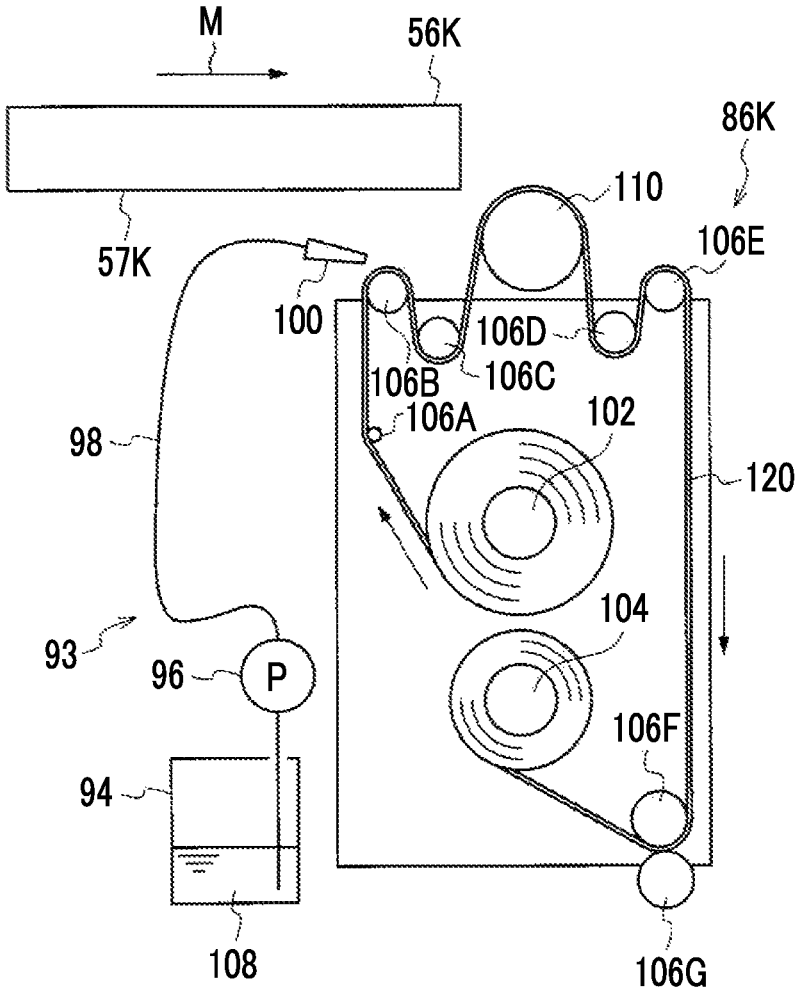
FIG. 3 is a schematic side view schematically illustrating a nozzle wiping unit according to the embodiment.

As illustrated in FIG. 3, the nozzle wiping unit 86 is configured to mainly include the nozzle wiping sheet 120, a sending-out side web core 102 as a sending-out part, a winding side web core 104 as a winding part, a plurality of guide rollers 106A, 106B, 106C, 106D, 106E, 106F, and 106G (hereinafter, collectively referred to as "guide roller 106"), a pressing roller 110 as a pressing part, and a cleaning liquid adding mechanism 93 as a cleaning liquid adding part.

The sending-out side web core 102 is a columnar member which horizontally extends and is supported to rotate about its axis, and the nozzle wiping sheet 120 is wound around the outer circumferential surface of the sending-out side web core 102 in a roll shape. On the other hand, the winding side web core 104 is a columnar member which horizontally extends and is supported to rotate about its axis, and the nozzle wiping sheet 120 which is sent out from the sending-out side web core 102 and wipes the nozzle surface 57K is wound in a roll shape. In addition, the winding side web core 104 is connected to a motor (not illustrated), and as the motor is driven, the nozzle wiping sheet 120 is rotated about is axis and is wound. In addition, as the nozzle wiping sheet 120 is wound, the nozzle wiping sheet 120 is continuously sent out from the sending-out side web core 102.

On a transport path of the nozzle wiping sheet 120 from the sending-out side web core 102 to the winding side web core 104, the guide rollers 106 are disposed. In addition, the nozzle wiping sheet 120 is wound around the guide rollers 106A, 106B, 106C 106D, and 106E in this order. Furthermore, the nozzle wiping sheet 120 passes through the guide rollers 106F and 106G which are vertically disposed and is wound around the outer circumferential surface of the winding side web core 104.

Here, the pressing roller 110 is disposed between the guide rollers 106C and 106D. The pressing roller 110 is formed in a columnar shape having a greater diameter than that of the guide roller 106 and is biased toward the upper side by biasing means (not illustrated). In addition, the pressing roller 110 is configured to press the nozzle wiping sheet 120 against the nozzle surface 57K of the ink jet head 56K to wipe the nozzle surface 57K during at least one movement of movement of the ink jet head 56K from the image forming position A to the maintenance position B or movement of the ink jet head 56K from the maintenance position B to the image forming position A.

In addition, in this embodiment, the band-like nozzle wiping sheet 120 is used as the wiping member. However, the wiping member is not limited thereto and is not limited to a sheet-like member as long as the wiping member is a member capable of wiping the nozzle surface 57 of the ink jet head 56. For example, a wiping member which is thicker than the nozzle wiping sheet 120 may be used. In addition, the pressing force of the pressing roller 110 is not particularly limited, and the pressing roller 110 may be configured to press the nozzle wiping sheet 120 to a degree at which the nozzle wiping sheet 120 comes into contact with the nozzle surface 57K.

The nozzle wiping unit 86 is provided with the cleaning liquid adding mechanism 93. The cleaning liquid adding mechanism 93 is configured to mainly include a storage tank 94 which stores a cleaning liquid 108, a pump 96, a dropwise addition part 100, and a tube 98.

The cleaning liquid 108 is stored in the storage tank 94, and as the pump 96 is driven, the pump 96 pumps up the cleaning liquid 108 in the storage tank 94. In addition, one end portion of the tube 98 extends to the inside of the storage tank 94 via the pump 96, and the other end portion of the tube 98 extends to the vicinity of the guide roller 106B. In addition, the other end portion of the tube 98 is provided with the dropwise addition part 100 such that a predetermined amount of the cleaning liquid 108 can be added dropwise (added) to the nozzle wiping unit 86 from the dropwise addition part 100.

In addition, in this embodiment, the cleaning liquid adding mechanism 93 which adds dropwise the cleaning liquid 108 to the nozzle wiping unit 86 is provided. However, the embodiment is not limited thereto, and a device which adds the cleaning liquid may be provided separately from the nozzle wiping unit 86. In addition, the cleaning liquid may be added by another method. For example, the cleaning liquid 108 may be added to the nozzle wiping sheet 120 using a roller or the like.

(Cleaning Liquid)

In this embodiment, as an example of the cleaning liquid 108, a liquid obtained by mixing components having the following composition and adjusting the mixture with nitric acid to reach a pH of 7.8 (25° C.) was used.

DEGmBE (water-soluble organic solvent represented by General Formula (I)) 20.0 mass %

DEG (humectant) 10.0 mass %

Imidazole (pKa=7.0, basic compound) 0.5 mass %

Benzotriazole 0.2 mass %

Deionized water residual amount when the total amount is 100 mass %

$$R^3\text{-}(\text{-}OR^4\text{-})_X OR^5 \qquad \text{General Formula (I)}$$

(Nozzle Wiping Sheet)

Next, the nozzle wiping sheet 120 will be described. The nozzle wiping sheet 120 is lengthily formed, and for example, is configured as a sheet formed by weaving microfiber fabric such as polyethylene terephthalate, polyethylene, and nylon.

In addition, the nozzle wiping sheet 120 is configured so that the shape of a drop of ink added after the cleaning liquid is added satisfies the following condition when the aspect ratio of the ink after 40 seconds after the addition of the cleaning liquid is assumed to be R.

$$R \geq 1.3$$

Furthermore, a direction in which the ink jet head 56 moves and a direction in which the ink spreads widest in the nozzle wiping sheet 120 intersect each other. Here, in this embodiment, as an example, as illustrated in FIG. 3, the nozzle wiping sheet 120 is disposed so that the direction (arrow M) in which the ink jet head 56K moves is, in a plan view, perpendicular to the direction in which the ink spreads widest.

(Evaluation of Spreadability of Ink)

The shape of a drop of ink added was measured as follows. First, the nozzle wiping sheet 120 is laid on a container such as a cup so as to cover the opening of the container. At this time, in a state in which both surfaces of a portion of the nozzle wiping sheet 120 to which the ink is added dropwise come into contact with the air, both end portions thereof are fixed while being pulled. Next, the cleaning liquid is added to the portion of the nozzle wiping sheet 120 to which the ink is added dropwise. The amount of the cleaning liquid is set to about 0.1 ml per 1 cm of the length of the nozzle wiping sheet 120. In addition, after the cleaning liquid is added, the cleaning liquid is left for about 10 seconds to be permeated. Thereafter, a drop (about 0.025 ml) of the ink was added dropwise by a syringe. At this time, this is imaged by imaging means such as a video camera to check the spreading state of the ink. In addition, the shape of the ink after a predetermined time after the cleaning liquid is added is checked, and by measuring the length of the ink in the direction in which the ink spreads widest and the length thereof in the perpendicular direction, the aspect ratio R is calculated.

(Actions and Effects)

Next, actions and effects of the embodiment will be described. In the image forming apparatus 10 according to this embodiment, as illustrated in FIG. 2, the nozzle surface 57 is wiped by the nozzle wiping sheet 120 during at least one movement of the movement of the ink jet head 56 from the image forming position A to the maintenance position B or the movement from the maintenance position B to the image forming position A.

Here, as illustrated in FIG. 3, the nozzle wiping sheet 120 sent out from the sending-out side web core 102 is pressed by the pressing roller 110 against the nozzle surface 57K of the ink jet head 56K and wipes liquid droplets such as ink adhered to the nozzle surface 57K. In addition, the nozzle wiping sheet 120 that has wiped the liquid droplets reaches the winding side web core 104 and is wound. Accordingly, the nozzle surface 57K can be efficiently wiped by the nozzle wiping sheet 120. In addition, since the cleaning liquid 108 is added by the cleaning liquid adding mechanism 93, the nozzle surface 57K can be effectively wiped.

However, when the nozzle surface 57 is wiped by the nozzle wiping sheet 120, bubbles (air) may be entrained into the nozzle and streaks may occur in a printed image immediately after the maintenance. Here, occurrence of streaks can be prevented when printing is performed after a period of time after the maintenance is performed. However, there is a possibility that productivity (the number of processed sheets) may decrease.

Here, in this embodiment, by using the nozzle wiping sheet 120 in which the ink is added dropwise in a state where the cleaning liquid is added and the aspect ratio R of the ink after 40 seconds after the addition of the cleaning liquid is 1.3 or more, ink can be absorbed at an appropriate absorption rate. Accordingly, bubbles can be prevented from being entrained into the nozzle of the ink jet head 56, and occurrence of streaks at the time of printing immediately after the maintenance can be prevented.

The above-described effects were confirmed by conducting the following experiments. Initially, a nozzle surface was wiped with a nozzle wiping sheet, and correction based on a nozzle check pattern and an auto-calibration pattern. Thereafter, 10 solid charts with mixed colors were printed. The sheet size at this time was 750 mm×532 mm. Next, the printed image was visually checked and streaks were checked. Here, only streaks caused by bubbles entrained into the nozzle were checked. Specifically, the presence or absence of streaks that might occur in the middle of the image and occur at occurrence locations that were not fixed was checked. This is because there is a high possibility that streaks that occur in the entire area of the image or streaks that occur only by a specific nozzle may be caused for other reasons such as non-jetting due to drying or the like.

Figure 4:
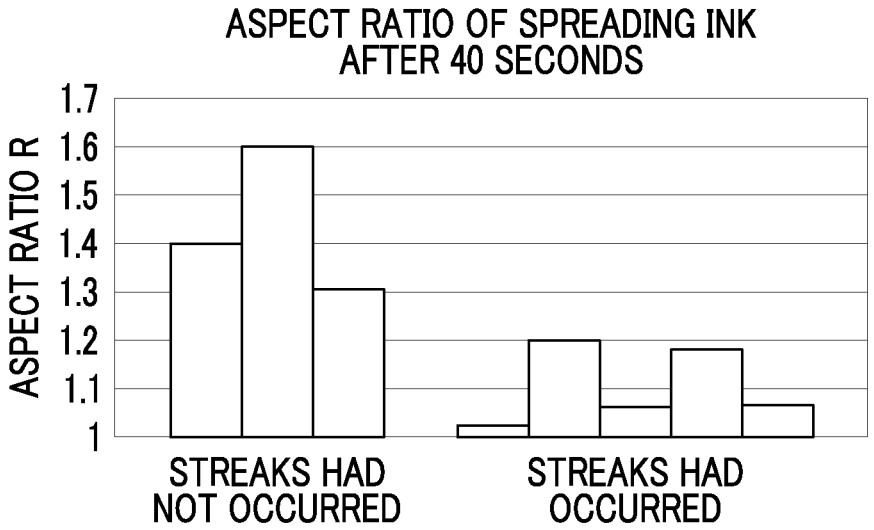
FIG. 4 is a graph showing the relationship between the presence or absence of streaks in a nozzle wiping sheet and the shape of spreading ink.

Here, on each of a nozzle wiping sheet where occurrence of streaks was confirmed and a nozzle wiping sheet where occurrence of streaks was not confirmed, the above-described ink spreadability evaluation was conducted, and the aspect ratio R of the ink after 40 seconds after the addition of the cleaning liquid was measured and shown in the graph of FIG. 4. In addition, as examples of the ink and the cleaning liquid, those having the above-described compositions were used.

According to the graph of FIG. 4, it can be seen that streaks do not occur when the nozzle wiping sheet in which the aspect ratio R of the ink after 40 seconds after the addition of the cleaning liquid is 1.3 or more is used. That is, it is known that the reason why the aspect ratio R of the spreading ink increases is because the absorption rate of the ink in a specific direction is delayed and the nozzle wiping sheet has a lower ink absorbing capacity than in a case where the ink spreads isotropically (the aspect ratio R is close to 1.0). Here, the nozzle wiping sheet having a high ink absorbing capacity quickly absorbs the ink, and the air easily infiltrates into the nozzle. Contrary to this, it is thought that the nozzle wiping sheet in which the aspect ratio R of the ink after 40 seconds is 1.3 or more does not quickly absorb the ink and can prevent bubbles from being entrained into the nozzle.

Figure 5:
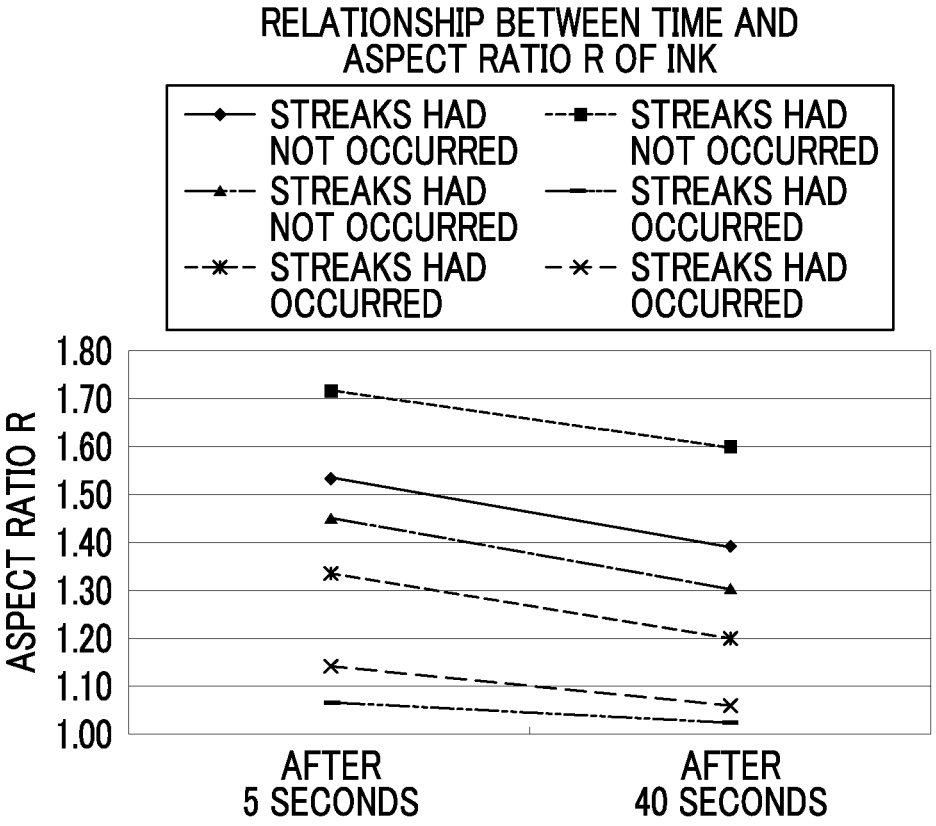
FIG. 5 is a graph showing a change over time in the aspect ratio R of ink added dropwise to the nozzle wiping sheet.

Next, FIG. 5 shows results of measurement of the aspect ratio R of the ink after 5 seconds and the aspect ratio R of the ink after 40 seconds after the addition of the cleaning liquid on each of the nozzle wiping sheet where occurrence of streaks was confirmed and the nozzle wiping sheet where occurrence of streaks was not confirmed. From the graph of FIG. 5, it can be seen that the aspect ratio R of the ink decreases with time and approaches 1.0. That is, it can be seen that the ink added dropwise to the nozzle wiping sheet spreads so as to approach a true circle in a plan view.

In addition, in the nozzle wiping sheet which did not cause streaks in the printed image, the aspect ratio R of the ink after 5 seconds and the aspect ratio R of the ink after 40 seconds were both 1.3 or more. In addition, in a case of a nozzle wiping sheet in which the aspect ratio R of the ink after 40 seconds was less than 1.3, occurrence of streaks in the printed image was confirmed even though the aspect ratio R of the ink after 5 seconds was 1.3 or more.

As described above, by using the nozzle wiping sheet in which the aspect ratio R of the ink after 40 seconds after the addition of the cleaning liquid is 1.3 or more, infiltration of air into the nozzle can be prevented, and occurrence of streaks during printing immediately after the maintenance can be prevented.

In addition, the reason why the aspect ratio R of the ink after 40 seconds after the addition of the cleaning liquid is measured is because the nozzle surface is wiped for about 5 seconds to 40 seconds after the cleaning liquid is added to the nozzle wiping sheet. However, this embodiment is not limited thereto, and a configuration in which it takes 40 seconds or longer for the nozzle surface to be wiped after the addition of the cleaning liquid may be employed.

In addition, in this embodiment, as illustrated in FIG. 3, the direction (arrow M) in which the ink jet head 56K moves and the direction in which the ink in the nozzle wiping sheet 120 spreads widest intersect each other. Accordingly, the ink easily spreads in the direction intersecting the transport direction of the ink jet head 56K, and thus the ink adhered when the nozzle surface 57K is wiped can be prevented from spreading to a region in which the nozzle wiping sheet 120 is not used. That is, re-adhesion of the wiped ink to the nozzle surface 57K can be prevented. Particularly, in this embodiment, since the direction (arrow M) in which the ink jet head 56K moves is perpendicular to the direction in which the ink in the nozzle wiping sheet 120 spreads widest, spreading of the ink in the transport direction of the nozzle wiping sheet 120 can be minimized. That is, the nozzle wiping sheet 120 can be effectively used.

In addition, since the image forming apparatus 10 of this embodiment is configured so as not to perform multiple writing, compared to an image forming apparatus which performs so-called multiple writing in which ink is jetted toward the same position of a recording medium P, the printing speed can be enhanced. Furthermore, by employing the singe pass manner as in this embodiment, the printing speed can be further enhanced than a so-called shuttle scan type image forming apparatus which performs printing while repeatedly moving an ink jet head.

Other Examples

While the present invention has been described with reference to the above-described embodiments, the present invention is not limited to the above-described embodiments, and various modifications can be made in a scope without departing from the gist. For example, although the transporting drum of the image forming apparatus 10 according to this embodiment is configured to transport two recording media P by one revolution (double cylinder), the present invention is not limited thereto, and the number of transported sheets is not particularly limited. For example, a configuration in which three sheets are transported (triple cylinder) may be employed. Otherwise, a configuration in which only a single sheet is transported by one revolution may also be employed.

In addition, in this embodiment, the configuration in which the ink jet head which jets ink as liquid droplets is used is described. However, the present invention is not limited thereto, and the nozzle wiping sheet 120 may be used as a wiping member which wipes a jetting head provided with a nozzle through which another type of liquid droplet is jetted.

EXPLANATION OF REFERENCES

10: image forming apparatus
56K, 56Y, 56M, 56C: ink jet head (jetting head)
57K, 57Y, 57M, 57C: nozzle surface
86K, 86Y, 86M, 86C: nozzle wiping unit
93: cleaning liquid adding mechanism (cleaning liquid adding part)
102: sending-out side web core (sending-out part)
104: winding side web core (winding part)
110: pressing roller (pressing part)
108: cleaning liquid
120: nozzle wiping sheet (wiping member)
A: image forming position
B: maintenance position
P: recording medium

What is claimed is:

1. An image forming apparatus comprising:

a jetting head provided with a nozzle through which liquid droplets are jetted toward a recording medium;

a jetting head moving mechanism which moves the jetting head between an image forming position and a maintenance position; and a nozzle wiping unit, which is provided between the image forming position and the maintenance position to face the jetting head, wherein the nozzle wiping unit includes a wiping member, a sending-out part which continuously sends out the wiping member, a winding part which winds the wiping member that is sent out, and a pressing part which is provided between the sending-out part and the winding part and presses the wiping member against a nozzle surface of the jetting head, wherein the wiping member wipes the nozzle surface of the jetting head provided with the nozzle through which liquid droplets are jetted, wherein a shape of the liquid droplet added dropwise to the wiping member after a cleaning liquid is added to the wiping member satisfies the following condition when an aspect ratio of the liquid droplet after 40 seconds after the addition of the cleaning liquid is assumed to be R, $R \geq 1.3$, wherein the nozzle surface of the jetting head is wiped with the wiping member during at least one movement of movement of the jetting head from the image forming position to the maintenance position or movement of the jetting head from the maintenance position to the image forming position, wherein the liquid droplet jetted from the jetting head is ink including a pigment, polymer particles, and water, and wherein the cleaning liquid added to the wiping member includes a water-soluble organic solvent represented by General Formula (I) and water $$R^3\text{-}(\text{-}OR^4\text{-})_x OR^5 \qquad \text{General Formula (I).}$$

2. The image forming apparatus according to claim 1, wherein the nozzle wiping unit further includes a cleaning liquid adding part which adds a cleaning liquid to the wiping member.

3. The image forming apparatus according to claim 1, $$R^3\text{-}(\text{-}OR^4\text{-})_x R^5 \qquad \text{General Formula (I)}$$

wherein a direction in which the jetting head moves and a direction in which the liquid droplet in the wiping member spreads widest intersect each other.

4. The image forming apparatus according to claim 3, wherein the nozzle wiping unit further includes a cleaning liquid adding part which adds a cleaning liquid to the wiping member.

* * * * *